United States Patent [19]

Fujiwhara et al.

[11] 4,094,682

[45] June 13, 1978

[54] METHOD FOR PROCESSING LIGHT-SENSITIVE SILVER HALIDE PHOTOGRAPHIC MATERIAL

[75] Inventors: Mitsuto Fujiwhara; Syunji Matsuo; Toyoaki Masukawa; Mikio Kawasaki; Yutaka Kaneko, all of Hino, Japan

[73] Assignee: Konishiroku Photo Industry Co., Ltd., Hino, Japan

[21] Appl. No.: 734,271

[22] Filed: Oct. 20, 1976

[30] Foreign Application Priority Data

Oct. 24, 1975 Japan ..... 50-127936

[51] Int. Cl.[2] ..... G03C 7/00; G03C 7/16; G03C 5/32

[52] U.S. Cl. ..... 96/55; 96/22; 96/60 R

[58] Field of Search ..... 96/60, 55, 22, 60 BF, 96/48 R, 50 R, 66

[56] References Cited

U.S. PATENT DOCUMENTS

| | | | |
|---|---|---|---|
| 3,674,490 | 7/1972 | Matejec | 96/48 R |
| 3,822,129 | 7/1974 | Dunn et al. | 96/74 |
| 3,841,873 | 10/1974 | Mowrey et al. | 96/22 |
| 3,862,842 | 1/1975 | Bissonette | 96/55 |

*Primary Examiner*—Mary F. Kelley
*Attorney, Agent, or Firm*—Haseltine, Lake & Waters

[57] ABSTRACT

An improved method for processing an imagewise exposed light-sensitive silver halide photographic material containing a coupler is described, wherein the siliver halide photographic material is processed with a developing bath and thereafter processed, in the presence of imagewise developed silver and a color developing agent, with a solution containing hydrogen peroxide, whereby, after the development, the developed light-sensitive silver halide photographic material is processed with a solution containing a deactivating agent or a silver halide solvent, and thereafter subjecting the thus processed light-sensitive silver halide photographic material to spraying with and/or intermittent dipping in said solution containing hydrogen peroxide.

3 Claims, No Drawings

METHOD FOR PROCESSING LIGHT-SENSITIVE SILVER HALIDE PHOTOGRAPHIC MATERIAL

This invention relates to an improved method for processing a light-sensitive silver halide photographic material comprising a coupler with a solution containing hydrogen peroxide to obtain an amplified dye image. More particularly, the invention is concerned with an improved method for processing a light-sensitive silver halide photographic material, whereby the dye image amplification becomes possible which shows stable amplification ratio (which will be defined hereinafter) and less formation of fog.

A light-sensitive silver halide photographic material has long been used widely because of its high photosensitivity and excellent image-forming ability. Recently, however, it becomes serious for many manufacturers of photographic products that the shortage of silver resources have brought a rise of cost of the silver. Therefore, the development of a silver-saving photographic image-forming system has been demanded. One of the systems which can meet the above-mentioned demand is a so-called silver-saved type light-sensitive silver halide photographic system, and several techniques concerning such a photographic system have already been known.

For example, Japanese Patent Publication No. 13576/74 discloses a method using a so-called 2-equivalent type coupler which is prepared by introducing a substituent into the active position of a color coupler in place of hydrogen, with attaining such advantage that the amount of silver required for form one molecule of a dye, which amount has heretofore been four atoms, can be reduced to two atoms. According to said method, the theoretical amount of silver to be used may be reduced to one-half the amount required in the case where the conventional 4-equivalent type coupler is used, and, in practice, it is possible to reduce the amount of silver to less than one-half the amount required in the case of the 4-equivalent type coupler, since the 2-equivalent type coupler is higher in silver efficiency than the 4-equivalent type coupler. Even when such method is adopted, however, the upper limit of the amount of silver capable of being reduced is about one-third the amount required at present, and no more reduction in amount of silver can be expected.

As another method, there has been proposed a so-called image amplification method in which the oxidation product of a developing agent is formed more effectively by use of developed, silver as a catalyst, thereby forming a high density color image. According to this method, the developed silver can be repeatedly used many times, so that color images can be obtained quite efficiently and the amount of silver can be reduced to a great extent. As such typical techniques for the image amplification of light-sensitive silver halide photographic materials, there have heretofore been known, for example, the method disclosed in British Pat. No. 1,268,121 in which the images are amplified by use of peroxy compounds, and the method disclosed in Japanese Laying-Open-to-Public No. 9728/73 in which color images are amplified taking advantage of the catalytic actions of cobalt complexes. Further, as to a similar technique for the amplification of color images, J. S. Friedman suggests, on page 406 of "History of Color Photography (1956)", the possibility of color image amplification by use of hydrogen peroxide and p-phenylenediamine. All these methods can effectively increase the densities of dye images and hence are quite effective techniques when viewed from the standpoint of the saving of silver resources. However, it is the actual state that the said methods have not satisfactorily been put into practice yet. The major reason therefore lies in that the processing baths used in said methods are extremely low in storability. Hydrogen peroxide and cobalt (III) ion complex salts have been known as typical oxidizing agents for amplifying color images, for example, and it appears that hydrogen peroxide is superior in efficiency. Despite the fact that hydrogen peroxide has been well known as an oxidizing agent hitherto, a method using hydrogen peroxide has not come to be put into practice. This is ascribable to such two great disadvantages of the said method that marked for fog tends to be formed in photographic materials and that the amplification ratio is unstable (the term "amplification ratio", referred to herein means, the ratio between the maximum density, assumed as 1, obtained in the case where a photographic material is exposed and then subjected to usual processing, and the maximum density obtained in the case where the same photographic material as above is exposed in the same manner as above and then subjected to amplification processing). In order to overcome these disadvantages, there have been proposed methods using chelating agents or stabilizers in combination with hydrogen peroxide. According to these methods, the processing baths can somewhat withstand the processing when the running period is within one week, but if the running period is made longer, there are brought about such great drawbacks that not only the formation of fog and the degradation in maximum density ($D_{max}$) becomes marked, but also the processing time required for the attainment of a definite amplification ratio is greatly extended.

On the other hand, when hexaaminecobalt trichloride or the like cobalt (III) ion complex salt is used, the processing bath is lowered in amplification ability within such a short period as 3 hours in extreme cases, and if the bath is allowed to stand for about 2 weeks, severe fog is formed in the photographic material processed therewith even when the processing solution has completely been sealed with nitrogen gas. In order to overcome this disadvantage, many improvements have been proposed. When evaluated from the standpoint of practicability, however, the said improvements are no more than minor improvements.

With an aim to overcome the above-enumerated drawbacks, we have now accomplished the present invention.

It is therefore a primary object of the present invention to provide a method for processing light-sensitive silver halide photographic materials, whereby color image amplification becomes possible in which excellent color images can be obtained at less formation of fog from light-sensitive silver halide photographic materials reduced in amount of silver.

A still further object of the invention is to provide a method for processing light-sensitive silver halide photographic materials, which method is capable of sufficiently withstanding a long period running in a large scale color laboratory or the like and maintaining constantly high amplification capacity over a long period of time.

The above objects as well as other objects of the invention which will become apparent from the following description can be accomplished by adoption of a method for processing light-sensitive silver halide photographic materials, wherein hydrogen peroxide is catalytically decomposed by the action of developed silver imagewise distributed in a photographic coupler-containing light-sensitive silver halide photographic material and a color developing agent is, in accompany with the catalytic decomposition reaction, oxidized to be brought into reaction with the coupler, thus forming imagewise amplified color images, characterized in that the light-sensitive silver halide photographic material is, after being imagewise exposed and developed, processed with a solution containing a compound capable of deactivating, or a compound capable of removing, the silver halide at the unexposed portion (hereinafter the former compound will be referred to as "deactivator" and the latter compound "silver halide solvent"), and thereafter subjected to spraying with and/or intermittent dipping in a hydrogen peroxide solution in the presence of the color developing agent.

In this method, the color developing agent may be incorporated into the light-sensitive silver halide photographic material to be used or included previously in a developing bath. It is also possible to prepare separately a solution containing a color developing agent and incorporate the color developing agent into the light-sensitive silver halide photographic material, for example by means of dipping in or spraying with the solution.

As for the deactivator and silver halide solvent used in the present invention for processing, prior to processing with hydrogen peroxide, light-sensitive silver halide photographic materials, it suffices to use at least one of them. The term "deactivator" is used herein to mean a substance which reacts with or is adsorbed to active silver or active site, i.e. so-called fog nuclei, which are present in the silver halide at the unexposed portion and form fog upon development, thereby to depress, perfectly or partially, their reactivity with developing agents.

As deactivators preferable for use in the present invention, there may be shown, for example, mercapto compounds, azole compounds, oxoniums, halogen ions and dyes. Concrete examples of the deactivators used in the present invention are shown below, but deactivators usable in the present invention are not limited to these.

(Mercapto compounds)

(1) 2-Mercaptobenzimidazole
(2) 2-Mercaptobenzothiazole
(3) 2-Mercapto-5-nitrobenzothiazole
(4) 4-Methyl-2-mercaptothiazole
(5) 4,5-Dimethyl-2-mercaptothiazole
(6) 1-Phenyl-5-mercaptotetrazole
(7) 1,2-Dimethyl-5-mercapto-1,3,4-triazole
(8) 2-Mercapto-5-phenyl-1,3,4-oxadiazole
(9) Mercaptoacetic acid
(10) β-Mercaptopropionic acid
(11) Thiosalicylic acid (Azole compounds)

(12) Benzotriazole
(13) 5-Nitrobenzimidazole
(14) 5-Methylbenzotriazole
(15) 4-Chlorobenzotriazole
(16) 5,5-Diphenylhydantoin
(17) 2-Methyl-3-(γ-sulfoxypropyl)benzoselenazole
(18) 3-Methylbenzothiazole toluenesulfonate (Oxonium compounds)

(19) N-Isopropyl-α-picolinium bromide
(20) N-Ethyl-2-methylbenzothiazolium chloride (Dyes)

(21) Phenosafranine
(22) Pinakryptol yellow
(23) 1,1',3,3,3',3'-Hexamethyl-5,5'-dinitroimidocarbocyanine-p-toluenesulfonate
(24) 1,3-Diallyl-2-[(3,5-dimethyl-1-phenyl-4-pyrazolyl)-vinyl]-imidazo-[4,5-b]-quinoxalium iodide (Others)

(25) Benzyladenine
(26) 8-Hydroxyquinoline
(27) o-Phenanthroline
(28) Thiosugar

All the above-mentioned compounds are those which are adsorbed on silver halides or react with silver to form sparingly soluble silver salts, and can advantageously be used in the present invention.

In the present invention, a photographic coupler-containing light-sensitive silver halide photographic material is developed and, prior to processing with an amplifying bath containing hydrogen peroxide, is processed with a bath containing the aforesaid deactivator. This may contain only the deactivator or may additionally contain other processing chemicals.

According to a preferred embodiment of the present invention, the deactivator is incorporated into a color developer. According to another preferred embodiment of the present invention, the deactivator is used in combination with a black-white developing agent or a color developing agent to form a processing solution.

The amount of the deactivator used in the present invention varies depending on the kind thereof and the kinds of the processing bath and photographic material used and may be in the range of from 0.1 mg to 20 g/l, although it is in general in the range of from 1 to 500 mg/l, preferably from 3 to 100 mg/l.

Further, typical examples of the treatment steps, to which the processing method of the present invention using deactivators is applicable, are as shown below, but the invention is not limited to these, wherein [ ] represents a deactivator-containing bath, and the letter in ( ) shows the presence of black-white developing agent B or color developing agent C. "Amplification" represents spraying with and/or intermittent dipping in a hydrogen peroxide-containing solution as will be described in more detail hereinafter.

1. [Development (C)] — amplification — bleach-fixing — water-washing — stabilization.
2. [Development (B)] — water-washing — pre-bath (C) — amplification — fixing — water-washing.
3. Development (B) — [pre-bath (C)] — amplification — fixing — water-washing.
4. [Development (B and C)] — amplification — water-washing.
5. Development (B) — bleaching — secondary exposure — [secondary development (B and C)] — amplification — water-washing — stabilization — rinsing.
6. Development (C) — [pre-bath (C)] — amplification — bleaching — water-washing — fixing — water-washing — stabilization — rinsing.

7. Development (B) — secondary exposure — Development (C) — amplification — bleach-fixing — water-washing — stabilization.
8. Development (B and C) — amplification — bleach — fixing — water-washing — stabilization.
9. Development (B and C) — amplification — fixing — water-washing — stabilization.
10. Development (B and C) — amplification — bleaching — fixing — water-washing — stabilization.

The term "silver halide solvent" is used herein to mean a substance which is used, after the development of a light-sensitive silver halide photographic material and before the processing thereof with a hydrogen peroxide-containing solution, to dissolve and remove the silver halide at the unexposed portion.

As silver halide solvents preferable for use in the present invention, there may be shown, for example, thiosulfates, thiocyanates, cyanides, amino acid type compounds, thiourea type compounds and thioether type compounds. Concrete examples of the silver halide solvents used in the present invention are sodium thiosulfate, potassium thiosulfate, ammonium thiosulfate, potassium cyanide, sodium cyanide, sodium thiocyanide, ammonium thiocyanate, thiosinamine, cystine, cysteine, methionine, thiourea, phenylthiourea, 3,6-dithia-1,8-octanediol, 3,12-dioxa-6,9-dithia-1,14-tetradecanediol and 3,6,9-trithiahendecanedioic acid, although the silver halide solvents usable in the present invention are not limited to these.

The amount of the silver halide solvent used in preparing the processing solution according to the present invention varies depending on the kind thereof and the kinds of the processing bath and photographic material used, but is preferably in the range of from 1 to 20 g/l when it is used in combination with the developing agent, and in the range of from 1 to 200 g/l when it is used alone. In this case, the pH of the processing solution is preferably in the range of from 6 to 12. The processing solution may be incorporated with, in addition to the developing agent, suitable amounts of various additives used in ordinary black-white developers, color developers and fixing solutions, e.g. preservatives, development accelerators, inhibitors, alkali agents, pH regulators, buffer agents and hardeners.

Typical examples of the treatment steps, to which the processing method of the present invention using a silver halide solvent-containing solution is applicable, are as shown below, but the invention is not limited to these, wherein [ ] represents a bath containing a silver halide solvent according to the present invention, and the letter in ( ) shows the presence of black-white developing agent B or color developing agent C. "Amplification" represents the processing with a hydrogen peroxide-containing solution according to the present invention.

"Pre-bath" in the following treatment steps represents a bath containing a color developing agent, in which bath a light-sensitive silver halide photographic material is dipped to incorporate the color developing agent thereinto.

1. Development (B) — [ ] — pre-bath (C) — amplification — bleach-fixing — water-washing — stabilization — rinsing.
2. Development (C) — amplification — water-washing — stabilization — rinsing.
3. Development (B) — bleaching — secondary exposure — secondary development (C) — [ ] — pre-bath (C) — amplification — water-washing.
4. Development (B) — water-washing — pre-bath (C) — amplification — water-washing — stabilization.
5. Development (B) — water-washing — pre-bath (C) — amplification — water-washing.

In the said treatment, typical examples of color developing agents preferable for use in the present invention are p-aminophenol compounds and p-phenylenediamine compounds. Specific examples of such compounds include p-aminophenol, diethyl-p-phenylenediamine hydrochloride, monomethyl-p-phenylenediamine hydrochloride, dimethyl-p-phenylenediamine hydrochloride, 2-amino-5-diethylaminotoluene hydrochloride, 2-amino-5-(N-ethyl-N-dodecylamino)-toluene, N-ethyl-N-βmethanesulfonamidoethyl-3-methyl-4-aminoaniline sulfate, N-ethyl-N-β-methanesulfonamidoethyl-4-aminoaniline, 4-N-ethyl-N-β-hydroxyethylaminoaniline, 4-amino-3-methyl-N,N-diethylaniline hydrochloride, 4-amino-3-methyl-N-ethyl-N-β-hydroxyethylaniline sulfate, 4-amino-3-β-(methanesulfonamido)-ethyl-N,N-diethylaniline, 4-amino-N-(2-methoxyethyl)-m-toluidine, etc.

These color developing agents may be used either singly or in admixture of two or more of them, or they may be used in combination with a black-white developing agent such as hydroquinone. In the present invention, the black-white developer or color developer may contain, in addition to these, an alkali agent such as, for example, sodium hydroxide, ammonium hydroxide, sodium carbonate, sodium sulfate, and sodium sulfite, and may contain various additives, e.g. an alkali metal halide such as potassium bromide, and a development regulator such as citrazinc acid.

The photographic material, which has been subjected to color development in the above-mentioned manner, is then processed, either as it is or after simple water-washing (rinsing) or after treatment with a pre-bath containing a color developing agent, with a hydrogen peroxide-containing bath to effect amplification. The concentration of the hydrogen peroxide-containing solution used in the present invention varies depending on the kind of the photographic material, the kind of the color developing agent, the running speed and other conditions used in the specific processing, although it is in general in the range of from 0.1 to 40%, preferably from 0.3 to 12%.

The amplification processing with a hydrogen-containing solution according to the present invention is carried out by means of spraying and/or intermittent dipping. As a result of our extensive studies, we have found that the amplification by use of hydrogen peroxide shows less fog formation and more stable amplification ratio when effected, as in the present invention, by means of spraying and/or intermittent dipping than when effected by means of continuous dipping of photographic materials.

Further, the adoption of the spraying method and ordinary dipping method in processing with a hydrogen peroxide containing solution, as in the present invention, has the following advantages. Thus, when amplification processing is carried out continuously in a color laboratory or the like, the concentration of the developing agent in the bath containing hydrogen peroxide increases gradually due to carry-over and diffusion. Such an amplifying bath enriched with developing agents would cause increase in amplification ratio of the resultant color images and in color fog formation, and, in extreme cases, color staining. Occurrence of these troubles makes the quality of color images markedly changeable, with the result that yield becomes lower in a color laboratory or the like and cost becomes higher. It appears to be effective for ensuring constant high quality to increase the quantity of the hydrogen peroxide-containing solution supplied to preclude such accumulation of developing agents, that is to say, to keep the concentration of the developing agent under a certain level. In addition, hydrogen peroxide is easily available as a reagent or an industrial chemical and it is also possible to prepare it even in a color laboratory or the like, for example by using a hydrogen peroxide generator utilizing electrolytic oxidation or the like. Therefore, the use of somewhat large quantities of hydrogen peroxide would not be a decisive drawback. However, when a photographic material is continuously dipped in a bath containing hydrogen peroxide, it is extremely difficult to control the processing, because the concentration of the developing agent is changeable, causing such troubles as described above. According to the method of the present invention, wherein the amplification of photographic materials is effected not by continuous dipping but by intermittent dipping in or spraying with a hydrogen peroxide-containing solution, the amount of the hydrogen peroxide used in a practical running can be reduced to less than one-fifth that used in the method wherein hydrogen peroxide is supplemented. In addition to this advantage, the method of the invention has the advantages of easy maintenance and low cost because the concentration of the developing agent is unchangeable and constant high yield can be ensured.

It also has been found, as a result of our studies, that although color develops well even in the air during amplifying processing if the photographic material contains hydrogen peroxide, it is required to compensate for the loss of hydrogen peroxide due to side reactions by supplementing intermittently hydrogen peroxide since there is no supplementation of hydrogen peroxide in the air. As a consequence, in the method according to the present invention, photographic materials are contacted with a hydrogen peroxide-containing solution for a certain period of time, and after a certain period of time following that, they are brought into contact therewith. In a preferred embodiment of the invention, they are kept in contact with a hydrogen peroxide-containing solution for a period of from 20 to 50 seconds at intervals of from 30 to 10 seconds. As to how to bring photographic materials into contact with a hydrogen-containing solution, there may be used a hydrogen peroxide-containing bath (the ordinary dipping method) or the spray method.

If necessary, a photographic material to which the method of the invention is applied may be subjected to, in addition to the above-mentioned treatments, prehardening treatment and to pre-bath treatment for better impregnation with the color developing agent, and, in the case of reversal development, it may be subjected to black-white development, bleaching, etc. In case the silver halide or developed silver is desired to be removed out of the system, there is adopted a treatment using a fixing solution, either alone or in combination with a bleaching solution, or using a bleach-fixing solution, in general. This treatment is carried out in combination with other various treatments such as, for example, water-washing, stopping and stabilization treatment. As the fixing component, there is used a silver halide solvent such as sodium thiosulfate or ammonium thiosulfate, while as the bleaching component, there is used potassium ferricyanide, ferric ammonium ethylenediaminetetraacetate or its sodium salt.

The method of the present invention is usable for the processing of a coupler-containing light-sensitive silver halide photographic material, and is advantageously applied particularly to a so-called silver-reduced light-sensitive silver halide photographic material containing a silver halide and a photographic coupler in an amount stoichiometrically larger than the available silver of said silver halide. According to the present invention, the amount of silver used can be reduced to less than one-fourth the amount of silver required in the prior art. Examples of the silver halide used in this case are silver chloride, silver bromide, silver iodide, and mixed silver halides such as silver chlorobromide, silver iodobromide and silver iodochlorobromide. Emulsions of these silver halides may be prepared by any known process. For example, the silver halide emulsion used in the present invention may be any of so-called conversion emulsion, Lipmann emulsion or covered grain emulsion which may have previously been fogged either optically or chemically, and is suitably selected according to the kind and usage of the resulting photographic material. Further, the kind, halogen content and proportion, average particle size and size distribution of the silver halide emulsion are also selected suitably according to the kind and usage of the resulting photographic material. For example, an emulsion composed mainly of silver halide which is fine in particle size and narrow in size distribution is used for preparation of a photographic material required to be relatively low in speed and high in image quality, while an emulsion relatively large in particle size and less in silver chloride content is used for preparation of a photographic material required to be relatively high in speed. Further, an emulsion which has previously been fogged is used for preparation of a direct positive type photographic material. These silver halide emulsions may be chemically sensitized by use of active gelatin; sulfur sensitizers, e.g. allylthiocarbamide, thiourea and cystine; selenium sensitizers; reduction sensitizers, e.g. stannous salts and polyamines; or noble metal sensitizers, e.g. gold sensitizers such as potassium aurithiocyanate, potassium chloroaurate and 2-aurosulfobenzothiazole methochloride, or sensitizers composed of water-soluble salts of ruthenium, rhodium and iridium, such as ammonium chloropalladate, potassium chloroplatinate and sodium chloropalladite (some of these act as sensitizers or antifoggants depending on their amounts), either alone or in proper combination (e.g. combination of gold sensitizer with sulfur sensitizer, or combination of gold sensitizer with selenium sensitizer).

Further, these silver halide emulsions may be optically sensitized to desired wavelength regions by use of optical sensitizers, e.g. cyanine or merocyanine dyes such as zeromethine, monomethine, dimethine or trimethine dyes. These sensitizers may also be used either alone or in combination (for example for the purpose of supersensitization).

The silver halide is dispersed in a suitable protective colloid to constitute a photosensitive layer. As protective colloids for constituting the photosensitive layer and other layers such as, for example, inter layer, protective layer and filter layer, gelatin is used in general. In addition thereto, there may be used gelatin derivatives, colloidal albumins, cellulose derivatives or synthetic resins such as polyvinyl compounds, e.g polyvinyl alcohols. These are used either alone or in combination with each other. Further, acetylcellulose having an acetyl content of about 19 to 26% or water-soluble ethanolamine cellulose acetate may be used in combination therewith.

The light-sensitive silver halide photographic materials used in the present invention contain couplers for forming color images. Example of useful couplers are open-chain methylene type yellow couplers, 5-pyrazolone type magenta couplers, and phenol or naphthol type cyan couplers. These couplers may be any of so-called 2-equivalent type or 4-equivalent type couplers, and may be used in combination with azo type colored couplers, osazone type compounds or development diffusible dye-yielding type couplers for automasking. In this case, it is desirable to use the above-mentioned masking couplers in combination with so-called colorless couplers which are colorless before color development. For further enhancement in photographic properties the photographic materials may be incorporated with so-called competing couplers, DIR (Development Inhibitor Releasing) couplers and BAR (Bleach Accelerator Releasing) couplers in combination with other couplers.

As yellow couplers, there have heretofore been used open-chain ketomethylene compounds. For example, effective as pivalyl acetanilide type yellow couplers are the compounds disclosed in French Pat. No. 1,291,110, and effective as benzoyl acetanilide type yellow couplers are the compounds disclosed in Japanese Patent Publication No. 19031/71 and U.S. Pat. No. 2,875,051. Further, the active position-O-allyl-substituted couplers as disclosed in U.S. Pat. No. 3,408,194, the active position-O-acyl-substituted couplers as disclosed in U.S. Pat. No. 3,447,928, the active position-hydantoin compound-substituted couplers as disclosed in Japanese Patent Laying-Open-to-Public No. 29432/73, the active position-urazol compound-substituted couplers as disclosed in Japanese Patent Laying-Open-to-Public No. 66834/73, the active position-succinic acid imide compound-substituted couplers as disclosed in Japanese Patent Application No. 119053/70, the active position-monooximide compound-substituted couplers as disclosed in Japanese Patent Application No. 7930/73, the active position-pyridazone compound-substituted couplers as disclosed in Japanese Patent Laying-Open-to-Public No. 10736/74, the active position-fluorine-substituted couplers as disclosed in British Pat. No. 944,490, the active position-chlorine- or bromine-substituted couplers as disclosed in British Pat. No. 780,507, and the active position-O-sulfonyl-substituted couplers as disclosed in British Pat. No. 1,092,506, which are so-called 2-equivalent type couplers, can be effective yellow couplers. Particularly effective among these yellow couplers are those disclosed in U.S. Pat. No. 3,408,194, Japanese Patent Laying-Open-to-Public No. 29432/73, Japanese Patent Application No. 79309/73 and Japanese Patent Laying-Open-to-Public No. 66834/73.

The magenta couplers used in the present invention include pyrazolone type, pyrazolotriazole type, pyrazolinobenzimidazole type, and indazolone type compounds. Preferable as the pyrazolone type magenta couplers are those disclosed in U.S. Pat. Nos. 3,127,269, 2,600,788, 3,519,429, 3,419,391 and 3,062,653, British Pat. No. 1,342,553, West German Pat. No. 2,162,778, Japanese Patent Laying-Open-to-Public No. 29639/74 and Japanese Patent Application No. 8433/69; preferable as the pyrazolotriazole type magenta couplers are those disclosed in West German Pat. No. 1,810,464, and Belgian Pat. No. 792,525; preferable as the pyrazolinobenzimidazole type magenta couplers are those disclosed in U.S. Pat. No. 3,061,432, Japanese Patent Publication No. 60479/71 and West German Pat. No. 2,156,111; and preferable as the indazolone type magenta couplers are those disclosed in Belgian Pat. No. 769,116. Among these, particularly preferable for use in the present invention are the magenta couplers disclosed in Japanese Patent Application No. 8433/69 and the 3-anilinopyrazolone magenta couplers disclosed in U.S. Pat. No. 3,127,269.

Useful cyan couplers usable in the present invention are the phenol compounds disclosed in, for example, U.S. Pat. Nos. 2,423,730, 2,801,171 and 2,895,826 and Belgian Pat. No. 779,512; the active position-O-arylsubstituted naphthol compounds disclosed in U.S. Pat. No. 2,474,293 and British Pat. No. 1,084,480; and the phenol and naphthol compounds disclosed in Japanese Patent Laying-Open-to-Public No. 37425/72 and Japanese Patent Application Nos. 57829/68, 69866/68, 10787/74, 16057/74, 25388/74 and 37160/74.

As colored magenta couplers, there are used colorless magenta couplers having active positions substituted by arylazo or heteroarylazo compounds which are disclosed in, for example, U.S. Pat. Nos. 3,005,712, 2,983,608 and 2,801,171, British Pat. No. 937,621 and Japanese Patent Application No. 8433/69.

As colored cyan couplers, there may be used the active position-arylazo-substituted couplers disclosed in, for example, U.S. Pat. Nos. 3,034,892 and 2,521,908, British Patent 1,255,111 and Japanese Patent Application No. 55665/71, and masking couplers of such type the dyes flow into the processing baths by reaction with the oxidation products of developing agents which are disclosed in, for example, Japanese Patent Application 57829/73, Japanese Patent Application No. 69866/73, Japanese Patent Application No. 16057/74, Japanese Patent Application No. 25388/74, Japanese Patent Application No. 37160/74 and British Patent 1,084,480.

As competing couplers, there are used, for example, citrazinic acid and the like compounds disclosed in U.S. Pat. No. 2,742,832; and as white couplers, there may be used those disclosed in West German Pat. No. 1,155,676.

A silver halide emulsion containing a photographic coupler, which has been prepared in the above manner, is applied to the form of a layer onto a support, if necessary together with sub layer, inter layer, filter layer, anticurling layer, protective layer, etc., whereby the light-sensitive silver halide photographic material used in the present invention is obtained. Examples of the support usable in this case are paper, laminated papers (e.g. a laminate of polyethylene and paper), glass plates, and films, or sheets of such substrates as cellulose acetate, cellulose nitrate, polyesters, polycarbonates, polyamides, polystyrenes and polyolefins. In order to enhance the adhesion thereof to the individual layers, the said supports may be subjected to various surface treatments such as, for example, saponification, corona discharge, subbing, setting, etc.

Fundamentally, a photographic material is composed at least of a support and a photosensitive layer provided thereon. As mentioned previously, however, it may have further proper layers at various positions for different purposes, and is composed of more than two layers, in general. Further, the photosensitive layer itself may be composed of a laminate of, for example, a layer containing a relatively high speed silver halide and a layer containing a relatively low speed silver halide which have been color-sensitized to same or different wavelength regions.

The photographic material used in the present invention may contain, for different purposes, various photographic additives in the photosensitive layer and/or other layers, e.g. inter layer, sub layer, filter layer, protective layer and image-receiving layer. Examples of such photographic additives are stabilizers, e.g. mercury compounds, triazoles, azaindenes, and quaternary benzothiazolium, zinc or cadmium salts; sensitizers such as quaternary ammonium salts or polyethylene glycols; film-property improvers, e.g. glycerin, dihydroxyalkanes such as 1,5-pentanediol, esters of ethylenebis-glycolic acid, bisethoxydiethylene glycol succinates, amides of acrylic type acids, and polymer emulsions or dispersions; hardeners, e.g. formaldehyde, halogen-substituted fatty acids such as mucochloric and mucobromic acids, compounds having acid anhydride groups, dicarboxylic acid chlorides, disulfonic acid chlorides, biesters of methanesulfonic acid, sodium bisulfite derivatives of dialdehydes whose aldehyde groups have been separated by 2 to 3 carbon atoms, bisaziridine, and ethyleneimines; vehicles, e.g. saponin, lauryl or oleyl monoethers of polyethylene glycols, and sulfated and alkylated polyethylene glycol salts; coating aids, e.g. sulfosuccinic acid salts; organic solvents, e.g. coupler solvents (high and/or low boiling organic solvents such as dibutyl phthalate, tricresyl phosphate, acetone, methanol, ethanol and ethylene cellosolve); so-called DIR compounds which, at the time of color development, yield development inhibitors and, at the same time, form substantially colorless compounds; and such additives as antistatic agents, defoaming agents, ultraviolet absorbers, fluorescent brightening agents, anti-slip agents, matting agents, and anti-halation or anti-irradiation agents. These additives may be used either singly or in combination of two or more members.

The light-sensitive silver halide photographic material used in the present invention can successfully be put into various uses, and are used as, for example, general negative photographic materials, general reversal photographic materials, general positive photographic materials, direct positive type photographic materials and photographic materials for specific uses (e.g. for printing, X-rays, high resolution, infrared, ultraviolet, etc.).

The present invention is illustrated in further detail below with reference to examples, but modes of practice of the invention are not limited to these examples.

EXAMPLE 1

A solution of a couplder 1-(2,4,6-trichlorophenyl)-3-[3-(2,4-di-tert-pentylphenoxy-acetamido)benzamide]-5-pyrazolone in dibutyl phthalate was protect-dispersed in aqueous gelatin solution to form a coupler dispersion. This dispersion was mixed with a silver chlorobromide emulsion, and the resulting mixture was coated on a resin-coated paper support, which had previously been subjected to corona discharge pre-treatment, and then dried to prepare a sample. In this case, the coated amounts of the silver and coupler per 100 $cm^2$ were 0.40 mg and 3.2 mg, respectively.

The thus prepared sample was exposed, and then developed at 30° C. for 1.5 minutes with a developer of the following composition:

| | |
|---|---|
| Sodium sulfite | 10.0 g |
| Hydroquinone | 5.0 g |
| Borax | 3.0 g |
| Sodium bicarbonate | 3.0 g |
| Boric acid | 3.5 g |
| Potassium bromide | 1.0 g |
| Phenidone | 2.0 g |
| Water to make | 1 liter |

Further, the aforesaid developed sample was processed at 30° C. for 1 minute with a deactivation bath of the composition shown below to deactivate the silver halide at the unexposed portion and, at the same time, to adsorb a paramine type compound thereon.

| | |
|---|---|
| 1-Phenyl-5-mercaptotetrazole | 0.01 g |
| N-Ethyl-N-β-methanesulfonamidoethyl-3-methyl-4-aminoaniline sulfate | 5.0 g |
| Anhydrous sodium sulfite | 2.0 g |
| Sodium carbonate (monohydrate) | 50.0 g |
| Potassium bromide | 1.0 g |
| Water to make | 1 liter |

Subsequently, the sample was sprayed at room temperature with an amplifying solution of the composition shown below to apply thereto 10 ml of the solution per 100 $cm^2$, and then subjected to the same desilver-fixing and stabilization treatments as in the case of usual color photographic materials to form a magenta image.

| | |
|---|---|
| 38% Aqueous hydrogen peroxide solution | 20 ml |
| Water to make | 1 liter |

The $D_{min}$ and $D_{max}$ of the thus obtained magenta image were 0.02 and 2.60, respectively.

For comparison, 50 sheets of 100 $cm^2$ samples, which were prepared and subjected to exposure, development and silver halide-deactivation treatments in the same manner as described above, were subjected successively to dipping in the same amplifying solution as used above. The $D_{min}$, which was 0.01 at the beginning of the dipping treatment, increased up to 0.06 at the end thereof.

As can be seen from these results, the amount of hydrogen peroxide required for amplification can be reduced ultimately by the spray method, when compared with the one used by the continuous dipping method at the same hydrogen peroxide concentration, and unchanged amplification performance can be maintained from beginning to end of the processing in the case of the spray method.

EXAMPLE 2

A solution of a coupler 2-(1-benzyl-2,4-dioxoimidazolidine-3-yl)-2-pivalyl-2'-chloro-5'-[4-(2,4-di-tert-pentylphenoxy)butanamide]acetanilide in dibutyl phthalate was protect-dispersed in aqueous gelatin to form a coupler dispersion. This dispersion was mixed with a silver chlorobromide emulsion, and the resulting mixture was coated on a resin-coated paper support. In this case, the coated amounts of the silver and coupler per 100 $cm^2$ were 1.00 mg and 8.23 mg, respectively. On this layer was then formed a gelatin inter layer containing dioctylhydroquinone. On this inter layer was further formed a layer composed of a mixture comprising a green-sensitive silver chlorobromide emulsion and a coupler dispersion prepared by protect-dispersing in an aqueous gelatin solution a solution in dibutyl phthalate of a coupler 3-{2-chloro-5-[1-(octadecyl)succinimido]-anilino]-1-(2,4,6-trichlorophenyl)-5-pyrazolone. The amounts of the coupler and silver used in said layer were 4.3 mg and 0.55 mg, respectively, per 100 cm². The said layer was further coated with a gelatin solution of dioctyl hydroquinone to form a color turbidity-preventing layer. On this layer was further formed a layer composed of a mixture comprising a red-sensitive silver chlorobromide emulsion and a coupler dispersion prepared by protect-dispersing in an aqueous gelatin solution a solution in dibutyl phthalate of a coupler 2-[2-(2,4-di-tert-pentylphenoxy)butanamido]-4,6-dichloro-5-methylphenol. The coated amounts of the coupler and silver used in said layer were 2.9 mg and 0.85 mg, respectively, per 100 cm². This layer was further coated with a gelatin protective layer and then with an ultraviolet-absorbing layer containing an ultraviolet absorber to form a color paper photographic material.

The thus obtained sample was print-exposed through a color negative film and then subjected to the following processing steps.

Development (1'30") — amplification — bleach-fixing (1') — water-washing (2') — stabilization (20")

All of these processings were carried out at 30° C., and the room temperature was 25° C. In these processings, there were used a development solution, an amplifying solution, a bleach-fixing solution and a stabilization solution of the following compositions.

Development solution:

| | |
|---|---|
| Anhydrous sodium sulfite | 10.0 g |
| Hydroquinone | 2.0 g |
| Phenidone | 0.6 g |
| Potassium carbonate | 20.0 g |
| N-Ethyl-N-β-methanesulfonamidoethyl-4-amino-3-methylaniline sulfate | 11.0 g |
| Sodium hydroxide | 5.0 g |
| 5-Nitro-benzimidazole | 0.5 g |
| Water to make (pH 11.0) | 1 liter |

Amplifying solution:

| | |
|---|---|
| 38% Aqueous hydrogen peroxide solution | 10 ml |
| Water to make | 1 liter |

Bleach-fixing solution:

| | |
|---|---|
| Ferric ammonium ethylenediaminetetra-acetate | 61.0 g |
| Ammonium thiosulfate | 124.5 g |
| Sodium metabisulfite | 13.3 g |
| Anhydrous sodium bisulfite | 2.7 g |
| Ethylenediaminetetraacetic acid diammonium salt | 5.0 g |
| Water to make (pH 6.5) | 1 liter |

Stabilization solution:

| | |
|---|---|
| Glacial acetic acid | 20 ml |
| Water | 800 ml |
| Sodium acetate to make | pH 3.5–4.0 |
| Water to make | 1 liter |

In the above-described processing steps, only the amplification step was carried out by the following three kinds of methods.

Method 1: The sample is dipped in the amplifying solution for consecutive four minutes.

Method 2: The sample was dipped in the amplifying solution for 15 seconds and then kept outside the solution for 15 seconds, after which it was dipped in the solution for 5 seconds and then kept outside the solution for 25 seconds and these two treatments are repeated two more times.

Method 3: The sample is sprayed with the amplifying solution to apply thereto 2.5 ml of the solution per 100 cm², and 30 seconds after that, the 2.5 ml spraying is repeated two times.

The minimum and maximum densities of the color images immediately after the processing, after the processing of 20 sheets of 100 cm² samples and after the processing of 40 sheets of 100 cm² samples were determined on the samples which had been subjected to the above described processing steps. The results are as shown in the following Table 1.

Table 1

| Amplification by | $D_{min}$ or $D_{max}$ | Color | Immediately after processing | After processing 20 sheets | After processing 40 sheets |
|---|---|---|---|---|---|
| Method 1 | $D_{min}$ | Blue | 0.01 | 0.02 | 0.03 |
| | | Green | 0.01 | 0.01 | 0.03 |
| | | Red | 0.01 | 0.02 | 0.02 |
| | $D_{max}$ | Blue | 2.27 | 2.40 | 2.25 |
| | | Green | 2.30 | 2.35 | 2.35 |
| | | Red | 2.20 | 2.32 | 2.30 |
| Method 2 | $D_{min}$ | Blue | 0.01 | 0.02 | 0.02 |
| | | Green | 0.01 | 0.01 | 0.02 |
| | | Red | 0.01 | 0.01 | 0.02 |
| | $D_{max}$ | Blue | 2.27 | 2.30 | 2.25 |
| | | Green | 2.30 | 2.30 | 2.30 |
| | | Red | 2.20 | 2.25 | 2.20 |
| Method 3 | $D_{min}$ | Blue | 0.02 | 0.02 | 0.02 |
| | | Green | 0.01 | 0.01 | 0.01 |
| | | Red | 0.01 | 0.01 | 0.01 |
| | $D_{max}$ | Blue | 2.27 | 2.30 | 2.30 |
| | | Green | 2.30 | 2.30 | 2.30 |
| | | Red | 2.20 | 2.20 | 2.20 |

As can be seen from Table 1, the amplifying solution, when applied by Method 2 or 3 according to the invention, exhibits not only excellent stability in performance, but also a high color forming speed.

EXAMPLE 3

A mixture comprising 1-hydroxy-N-[4-(2,4-di-tert-pentylphenoxy)butyl]-2-naphthamide (10.1 mg/100 cm²), 4-(2-ethoxycarbonylphenylazo)-1-hydroxy-N-[4-(2,4-di-tert-pentylphenoxy)butyl]-2-naphthamide (3.2 mg/100 cm²) and 1-oxo-2-(1-phenyl-5-tetrazolythio)-6-[α-(2,4-di-tert-pentylphenoxy)butanamido]indane (4.4 mg/100 cm²) was dissolved in tricresyl phosphate, and the solution was then protect-dispersed in an aqueous gelatin solution. The resulting dispersion was mixed with a high speed red-sensitive silver iodobromide emulsion (Ag 2.5 mg/100 cm²). The resulting mixture was then coated on one side of a clear cellulose triacetate film base which had been subjected to subbing treatment with an alkali.

The coated amounts of each coupler and silver were as shown in the parentheses.

On the thus formed emulsion layer was formed a layer composed of a gelatin solution of 2,5-dioctylhydroquinone, and on the resulting layer was further formed in the same way as in the case of the lower-most layer, an ortho layer composed of a mixture comprising a panchromatically sensitized silver iodobromide emulsion (Ag 1.84 mg/100 cm²) and a dispersion prepared by protect-dispersing in an aqueous gelatin solution a solution formed by dissolving in dibutyl phthalate an equivalent amount of 1-(2,4,6-trichlorophenyl)-3-[3-(2,4-di-tert-pentylphenoxyacetamido)benzamido]-5-pyrazolone (10.2 mg/100 cm²) and 1-(2,4,6-trichlorophenyl)-3-[3-(2,4-di-tert-pentylphenoxyacetamido)benzamido]-4-(4-methoxyphenylazo)-5-pyrazolone (2.2 mg/100 cm²). The coated amounts of the couplers and silver used in the ortho layer were as shown in the parentheses.

On the other side of the film base was formed a layer composed of a mixture comprising a panchromatically sensitized silver iodobromide and a dispersion prepared by protect-dispersing a solution in tricresyl phosphate of a 3.7: 3 mixture of 2-(2,4-dioxo-3,3-di-n-propyl-azetidine-1-yl)-2-pivalyl-2'-chloro-5'-[4-(2,4-di-tert-pentylphenoxy)butanamido]acetanilide and 1-hydroxy-N-[4-(2,4-di-tert-pentylphenoxy)butyl]-2-naphthamide. In this case, the coated amounts of the yellow coupler, cyan coupler and silver per 100 cm² were 5.55 mg, 4.5 mg and 2.75 mg, respectively.

The thus obtained color X-ray photographic material was exposed through a fluorescent intensifying screen and an aluminum wedge to X-rays from a tube energized at 60 $KV_p$ and 200 mA for 0.5 second, and the subjected to the same development and amplification treatments as in Example 2 to compare the three kinds of methods of amplification. The results obtained were substantially the same as those obtained in Example 2.

EXAMPLE 4

A polyester film base was coated with a mixture comprising a high speed silver iodobromide emulsion and a dispersion prepared by protect-dispersing, in the conventional manner using a dispersion aid Alkanol B (manufactured by Du Pont Nemours E. I.), an equimolar coupler mixture of 2-[2-(2,4-di-tert-pentylphenoxy)-butanamide]-4,6-dichloro-5-methyl-phenol, 1-(2,4,6-trichlorophenyl)-3-[3-(2,4-di-tert-pentylphenoxyacetamido)benzamido]-5-pyrazolone and 2-(1-benzyl-2,4-dioximidazolidine-3-yl)-2-pivaloyl-2'-chloro-5'-[2-(3-pentadecylphenoxy)butanamido]acetanilide. The coated amounts of the silver halide and couplers per 100 cm² were 5 mg (as Ag) and 21 mg, respectively.

The thus obtained photographic material was exposed through a fluorescent intensifying screen and an aluminum wedge to X-rays from a tube energized at 60 $KV_p$ and 200 mA for 0.5 second.

The exposed photographic material was then subjected, at 30° C., to the following processing steps:

Development (1') — amplification — fixing (1') — water-washing (2').

Finally it was dried and the comparison of photographic properties was made. All the processing steps were carried out in the same manner as in Example 2, except that there were used the below-mentioned processing solutions.

The amplification step also was effected, as in Example 2, by Method 1 (simple dipping method), Method 2 (intermittent dipping method) and Method 3 (spray method) to compare these methods with each other. The densities of the resulting dark-purplish black images were as shown in Table 2 shown below.

Development solution:

| | |
|---|---|
| Anhydrous potassium carbonate | 26.0 g |
| Anhydrous sodium bicarbonate | 3.5 g |
| Potassium sulfite (dihydrate) | 18.0 g |
| Potassium bromide | 1.3 g |
| Sodium chloride | 0.2 g |
| Sodium nitrilotriacetate (monohydrate) | 2.0 g |
| Potassium hydroxide | 0.4 g |
| Hydroxylamine sulfate | 2.0 g |
| 5-Nitrobenzimidazole | 0.5 g |
| 4-Amino-3-methyl-N-methyl-(β-hydroxyethyl)aniline sulfate | 5.0 g |
| Water to make (pH 10.5) | 1 liter |

Amplifying solution:

| | |
|---|---|
| 38% aqueous hydrogen peroxide solution | 25 ml |
| Water to make | 1 liter |

Fixing solution:

| | |
|---|---|
| Ammonium thiosulfate (70% aqueous solution) | 175.0 ml |
| Anhydrous sodium sulfite | 8.6 g |
| Sodium metabisulfite | 2.3 g |
| Water to make (pH 6.0) | 1 liter |

Table 2

| Amplification by | $D_{min}$ or $D_{max}$ | Immediately after processing | After processing 20 sheets | After processing 40 sheets |
|---|---|---|---|---|
| Method 1 | $D_{min}$ | 0.04 | 0.10 | 0.21 |
| | $D_{max}$ | 3.00 | 3.30 | 3.20 |
| Method 2 | $D_{min}$ | 0.08 | 0.10 | 0.14 |
| | $D_{max}$ | 3.00 | 3.10 | 3.10 |
| Method 3 | $D_{min}$ | 0.10 | 0.10 | 0.10 |
| | $D_{max}$ | 3.10 | 3.10 | 3.10 |

As can be seen from Table 2, uniform color images can be obtained by Methods 2 and 3 according to the present invention, even in prolonged running.

EXAMPLE 5

A solution of a coupler 2-(1-benzyl-2,4-dioxoimidazolidine-3-yl)-2-pivalyl-2'-chloro-5'-[4-(2,4-di-tert-pentylphenoxy)butanamido]acetanilide in dibutyl phthalate was protect-dispersed in an aqueous gelatin solution to form a coupler dispersion. This dispersion was mixed with a silver chlorobromide emulsion, and the resulting mixture was coated on a resin-coated paper support. In this case, the coated amounts of the silver and coupler per 100 cm² were 0.87 mg and 8.23 mg, respectively. On this layer was then formed a gelatin inter layer containing dioctylhydroquinone. On this inter layer was further formed a layer composed of a mixture comprising a green-sensitive silver chlorobromide and a coupler dispersion prepared by protect-dispersing in an aqueous gelatin solution a solution of a coupler 1-(2,4,6-trichlorophenyl)-3-[3-(2,4-di-tert-pentylphenoxyacetamido)benzamido]-5-pyrazolone in dibutyl phthalate. The amounts of the coupler and silver used in said layer were 4.7 mg and 0.97 mg, respectively, per 100 cm². The said layer was further coated with a gelatin solution of dioctylhydroquinone to form an anti color stain layer. On this layer was further formed a layer composed of a mixture comprising a red-sensitive silver chlorobromide emulsion and a coupler dispersion prepared by protect-dispersing in an aqueous gelatin solution a solution of a coupler 1-hydroxy-N-[4-(2,4-di-tert-pentylphenoxy)butyl]-2-naphthamide in dibutyl phthalate. The coated amounts of the coupler and silver used in said layer were 3.2 mg and 0.73 mg, respectively, per 100 $cm^2$.

The thus obtained sample was exposed through a wedge. 40 Sheets of such exposed samples each being 100 $cm^2$ in size were successively developed at 30° C for 1.5 minutes with a developer of the following composition:

| | |
|---|---|
| Sodium sulfite | 100 g |
| Hydroquinone | 5.0 g |
| Borax | 3.0 g |
| Sodium bicarbonate | 3.0 g |
| Boric acid | 3.5 g |
| Potassium bromide | 1.0 g |
| Phenidone | 0.2 g |
| Water to make | 1 liter |

The thus developed samples were processed at 30° C for 1.5 minutes with a processing bath of the following composition:

| | |
|---|---|
| Ammonium thiosulfate (70% aqueous solution) | 180 ml |
| Sodium sulfite | 7.0 g |
| Water to make (pH 6.0) | 1 liter |

The thus processed samples were further processed at 30° C for 1 minute with a processing bath of the following composition to adsorb a paramine type compound thereon.

| | |
|---|---|
| N-Ethyl-N-β-methanesulfonamido-ethyl-3-methyl-4-aminoaniline sulfate | 5.0 g |
| Anhydrous sodium sulfite | 2.0 g |
| Sodium carbonate (monohydrate) | 50.0 g |
| Potassium bromide | 1.0 g |
| Water to make | 1 liter |

Subsequently, the samples were sprayed at 30° C with an amplifying solution to apply thereto 10 ml of the solution per 100 $cm^2$, and then subjected to the same desilver-fixing and stabilization treatments as in the case of usual color photographic materials to form color images (Method 1).

| | |
|---|---|
| 38% aqueous hydrogen peroxide solution | 20 ml |
| Water to make | 1 liter |

For comparison, the amplification step was carried out by, in addition to Method 1, the following two more methods:

Method 2: Similar samples were dipped for consecutive four minutes in the amplifying solution.

Method 3: Similar samples were processed in the same manner as in the case of Method 2, except in that the bath containing a silver halide solvent according to the invention was not used.

The densities of the color images obtained from these samples were as shown in Table 3 which follows.

Table 3

| Amplification by | Processing | Densities of color images | | | | | |
|---|---|---|---|---|---|---|---|
| | | Red | | Green | | Blue | |
| | | $D_{min}$ | $D_{max}$ | $D_{min}$ | $D_{max}$ | $D_{min}$ | $D_{max}$ |
| Method 1 | Immediately after processing | 0.005 | 2.25 | 0.06 | 2.23 | 0.07 | 2.03 |

Table 3-continued

| Amplification by | Processing | Densities of color images | | | | | |
|---|---|---|---|---|---|---|---|
| | | Red | | Green | | Blue | |
| | | $D_{min}$ | $D_{max}$ | $D_{min}$ | $D_{max}$ | $D_{min}$ | $D_{max}$ |
| | After processing of 40 sheets | 0.05 | 2.25 | 0.06 | 2.22 | 0.07 | 2.04 |
| Method 2 | Immediately after processing | 0.05 | 2.27 | 0.06 | 2.24 | 0.08 | 2.03 |
| | After processing of 40 sheets | 0.08 | 2.25 | 0.09 | 2.22 | 0.10 | 2.04 |
| Method 3 | Immediately after processing | 0.05 | 2.29 | 0.06 | 2.28 | 0.06 | 2.08 |
| | After processing of 40 sheets | 0.33 | 2.20 | 0.38 | 2.13 | 0.46 | 2.03 |

As is clear from Table 3, the samples, which had been subjected to the amplification processing by Method 1 according to the present invention, gave excellent color images less in fog and sufficiently high in $D_{max}$ in comparison with those which had been processed by Methods 2 and 3.

What we claim is:

1. An improved method for processing an imagewise exposed light-sensitive silver halide photographic material containing a coupler, wherein the silver halide photographic material is processed with a developing bath and thereafter processed, in the presence of imagewise developed silver and a color developing agent, with a solution containing hydrogen peroxide, the improvement comprising processing, after the development, the developed light-sensitive silver halide photographic material with a solution containing a deactivating agent capable of being adsorbed on silver halide or reacting with silver to form sparingly soluble silver salts and selected from the group consisting of 2-mercaptobenzimidazole, 2-mercaptobenzothiazole, 2-mercapto-5-nitrobenzothiazole, 4-methyl-2-mercaptothiazole, 4,5-dimethyl-2-mercaptothiazole, 1-phenyl-5-mercaptotetrazole, 1,2-dimethyl-5-mercapto-1,3,4-triazole, 2-mercapto-5-phenyl-1,3,4- oxadiazole, mercaptoacetic acid, β-mercaptopropionic acid, thiosalicylic acid, benzotriazole, 5-nitrobenzimidazole, 5-methylbenzotriazole, 4-chlorobenzotriazole, 5,5-diphenylhydantoin, 2-methyl-3-(γ-sulfoxypropyl) benzoselenazole, 3-methylbenzothiazole toluenesulfonate, N-isopropyl-α-picolinium bromide, N-ethyl-2-methylbenzothiazolium chloride, phenosafranine, pinakryptol yellow 1,1',3,3,3',3'-hexamethyl-5,5-dinitroimidocarbocyanine-p-toluenesulfonate, 1,3-diallyl-2-[(3,5-dimethyl-1-phenyl-4-pyrazolyl)-vinyl]-imidazo-[4,5-b]-quinoxalium iodide, benzyladenine, 8-hydroxyquinoline, o-phenanthroline and thiosugar, and thereafter subjecting the thus processed light-sensitive silver halide photographic material to spraying with and/or intermittent dipping in said solution containing hydrogen peroxide.

2. An improved method for processing an exposed light-sensitive silver halide photographic material according to claim 1, wherein said color developing agent is selected from the group consisting of p-aminophenol compounds and p-phenylenediamine compounds.

3. An improved method for processing an exposed light-sensitive silver halide photographic material according to claim 2, wherein said light-sensitive silver halide photographic material contains a silver halide and a photographic coupler in an amount stoichiometrically greater than the developed silver of said silver halide.

* * * * *